US010961852B2

(12) United States Patent
Meng

(10) Patent No.: US 10,961,852 B2
(45) Date of Patent: Mar. 30, 2021

(54) TECHNIQUE FOR LOW-SPEED BALANCING OF A ROTOR OF A COMPRESSOR FOR A GAS TURBINE

(71) Applicant: Siemens Aktiengesellschaft, Munich (DE)

(72) Inventor: Zhiqiang Meng, Loughborough (GB)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 125 days.

(21) Appl. No.: 16/330,838

(22) PCT Filed: Sep. 4, 2017

(86) PCT No.: PCT/EP2017/072090
§ 371 (c)(1),
(2) Date: Mar. 6, 2019

(87) PCT Pub. No.: WO2018/050467
PCT Pub. Date: Mar. 22, 2018

(65) Prior Publication Data

US 2019/0211682 A1 Jul. 11, 2019

(30) Foreign Application Priority Data

Sep. 13, 2016 (EP) ..... 16188471

(51) Int. Cl.
*F01D 5/02* (2006.01)
*F01D 5/30* (2006.01)

(52) U.S. Cl.
CPC ..... *F01D 5/027* (2013.01); *F01D 5/303* (2013.01); *F01D 5/3038* (2013.01)

(58) Field of Classification Search
CPC ..... F01D 5/027; F01D 5/3038; G01M 1/36
See application file for complete search history.

(56) References Cited

U.S. PATENT DOCUMENTS 2,916,257 A 12/1959 Poellmitz
3,292,900 A 12/1966 Petterson
(Continued)

FOREIGN PATENT DOCUMENTS

CN 102414461 A 4/2012
CN 102483037 A 5/2012
(Continued)

OTHER PUBLICATIONS

International search report and written opinion dated Dec. 15, 2017, for corresponding PCT/EP2017/072090.

*Primary Examiner* — Paul M. West
*Assistant Examiner* — Mark A Shabman

(57) ABSTRACT

A method for low-speed balancing of a rotor having at least one compressor stage blades assembly includes a row of blades circumferentially arranged with circumferential clearance. Two or more blades are located blades, each having an angular position in the assembly, at which the located blades are maintained. The located blades define sectors. Each sector includes movable blades and sectoral circumferential clearances. The movable blades, for each sector, are circumferentially adjusted such that the sectoral circumferential clearance of the sector moves circumferentially downstream relative to the movable blades with respect to a rotational direction when the assembly is rotated. Relative position of the sectoral circumferential clearances and the movable blades within each sector is maintained by inserts. A measure of unbalance is determined for the rotor in low-speed balancing conditions. The inserts are removed after low speed balancing and the clearances are kept to accommodate the blade root thermal expansion.

10 Claims, 6 Drawing Sheets

(56) References Cited

U.S. PATENT DOCUMENTS

| | | | | |
|---|---|---|---|---|
| 3,584,971 | A * | 6/1971 | Ortolano | F01D 5/3038 416/218 |
| 4,901,523 | A * | 2/1990 | Huelster | F01D 5/026 416/198 A |
| 5,513,955 | A | 5/1996 | Barcza | |
| 2006/0266114 | A1* | 11/2006 | Pichel | F01D 5/027 73/460 |
| 2010/0215491 | A1 | 8/2010 | Mockridge et al. | |
| 2011/0027085 | A1* | 2/2011 | Glasspoole | F01D 25/04 416/145 |
| 2012/0099961 | A1* | 4/2012 | Delvaux | F01D 5/142 415/62 |
| 2012/0186343 | A1 | 7/2012 | Egedal | |
| 2013/0340521 | A1* | 12/2013 | Clark | F04D 29/662 73/462 |

FOREIGN PATENT DOCUMENTS

| | | | |
|---|---|---|---|
| CN | 104500446 | A | 4/2015 |
| DE | 1167852 | B | 4/1964 |
| EP | 2055897 | A1 | 5/2009 |
| EP | 3015654 | A1 | 5/2016 |
| GB | 191016889 | A | 10/1910 |
| JP | 2012087788 | A | 5/2012 |
| MY | 120992 | A | 12/2005 |
| RU | 2099541 | C1 | 12/1997 |
| SU | 1185139 | A1 | 10/1985 |

* cited by examiner

TECHNIQUE FOR LOW-SPEED BALANCING OF A ROTOR OF A COMPRESSOR FOR A GAS TURBINE

CROSS REFERENCE TO RELATED APPLICATIONS

This application is the US National Stage of International Application No. PCT/EP2017/072090 filed Sep. 4, 2017, and claims the benefit thereof. The International Application claims the benefit of European Application No. EP16188471 filed Sep. 13, 2016. All of the applications are incorporated by reference herein in their entirety.

FIELD OF INVENTION

The present technique relates generally to balancing of rotors and, more particularly to techniques of low-speed balancing of gas turbine compressor rotors with compressor stage blades assemblies.

BACKGROUND OF INVENTION

For rotors that operate below their critical speed, conventionally low-speed balancing is sufficient to balance the rotor before installation or operation of the rotor, since such rotors do not operate at speeds that cause conformational changes in the rotor.

Particularly for rotors having one or more compressor stage blades assemblies where a number of compressor blades, i.e. a row of compressor blades, are clamped circumferentially between opposing faces of two adjacent disks, or within opposing walls of a peripheral channel formed at a rim of a disk, to hold the row of compressor blades in position thus forming a stage of compressor blade assembly, generally a small circumferential clearance is included between the blades in the row to allow for thermal expansion of the compressor blades, particularly to allow for thermal expansion of the base parts i.e. roots and/or platforms of the compressor blades. Such compressor stage blades assemblies having the compressor blades clamped circumferentially between opposing faces of two adjacent disks are usually found from second stage onwards in the gas turbine compressor rotors.

As a result of the circumferential clearance, the compressor blades, hereinafter also referred to as the blades, can move circumferentially within the stage. Balancing of rotors having such a compressor stage blades assembly that have possibilities of movement of the blades is difficult because the blade movements cause unbalance variation from run to run of low-speed balancing. With blade movement within the compressor stage blades assembly, the low-speed balancing cannot accurately balance the rotor for operational speeds, because during low-speed balancing the compressor stage blades assembly is rotated at speeds for example 800 rpm, which is much lower than the operational speeds which for example may be between 8000 rpm to 14000 rpm or more. The blades stay at different positions within the compressor stage blades assembly in low-speed balancing compared to in actual operation due to blade movement caused due to operational speeds. The term 'low-speed' may be regarded herein as up to 20% of maximum rotational speed of an engine, advantageously up to 10% and more advantageously approximately 5% of maximum rotational speed. The term 'low-speed' is intended to mean that the blade assembly is rotating when balancing is performed and advantageously at least 1% of maximum rotational speed.

Thus the conventionally known methods for low-speed balancing are insufficient to balance rotors having the compressor stage blades assembly, where possibilities of blade movement within the assembly exist, for operational speeds. In the present disclosure, the term 'low-speed' means rotational speeds at which low-speed balancing is generally performed, and include rotations below critical speeds for the compressor stage blade assembly and/or the rotations at speeds that are lower, for example fifty percent lower, than speeds at which the compressor stage blades assembly generally operates when the gas turbine rotor assembly having the compressor stage blades assembly is positioned in a gas turbine engine and the gas turbine engine is operated. In present disclosure, the term 'operational speed' means speeds at which the compressor stage blades assembly generally operates when the gas turbine rotor assembly having the compressor stage blades assembly is positioned in a gas turbine engine and the gas turbine engine is operated to output specified power, which is below the critical speeds. Generally speaking, operational speed may be understood as the speed at which when the compressor stage blades assembly is rotated, the blades are located to their farthest possible position, due to the circumferential clearance, within the compressor stage blades assembly in a direction opposite to a direction of rotation of the compressor stage blades assembly.

U.S. Pat. No. 3,584,971 discloses a turbine rotor, comprising, a rotor disc having a circumferential groove, an annular array of blades carried by the disc and having root portions of the radial entry type. The root portions engaging the groove, the blades being disposed in arcuate groups having generally an equal number of blades in each group. The blades being provided with tenons, an arcuate shroud segment having equally spaced apertures adapted to mate with the tenons for joining the blades of each group so that the associated root portions of the blades within each group are disposed in end-to-end abutment. The number of blades in each group being generally equal to the number of blades that can mate with the equally spaced apertures of the shroud segment and remain in end-to-end abutment. The tenons being firmly connected to their associated shroud segments, and thin liner members interposed between the root portion of adjacent blade groups to adjust the thickness of the groups to a predetermined thickness. However, the thin liner members are permanent parts in the blade and rotor assembly and are used in normal engine operation.

Furthermore, in the present disclosure, the terms "unbalance" and "balance" are used conventionally and as used herein are terms of degree. The degree of balance is selected for obtaining ideally no unbalance, or relatively little unbalance, in accordance with conventional practice.

One way to solve the problem of balancing the rotors having at least one compressor stage blades assembly that has possibility of abovementioned blade movement, hereinafter also referred to as such compressor stage blades assembly or simply as such assembly would be to balance the compressor stage blades assembly while rotating the compressor stage blades assembly at operational speeds. However, there are significant problems of feasibility and cost to be overcome in balancing the rotors with such compressor stage blades assembly if rotated at operational speeds. Therefore, there is a need to accomplish the beneficial effects of operational-speed balancing or high-speed balancing without actually having to operate the compressor stage blades assembly at operational speeds or high speeds in the course of the balancing operation.

SUMMARY OF INVENTION

Thus, an object of the present disclosure is to provide a technique that accomplishes the beneficial effects of operational-speed balancing or high-speed balancing without actually having to operate the compressor stage blades assembly at operational speeds or high speeds in the course of the balancing operation, or in other words to say to achieve operation speed balance for the compressor stage blades assembly while performing low-speed balancing.

The above object is achieved by a method for low-speed balancing of a rotor having at least one compressor stage blades assembly of the present technique. Advantageous embodiments of the present technique are provided in dependent claims.

In the present technique, a method for low-speed balancing of a rotor having at least one compressor stage blades assembly is presented. The compressor stage blades assembly, hereinafter also referred to as the assembly, includes a row of compressor blades circumferentially clamped between two opposing faces of adjacent rotor discs, or between two opposing faces of a peripheral channel formed in a rim of one disk, to form a stage of a gas turbine compressor rotor. The assembly includes a circumferential clearance within the row of compressor blades i.e. in-between the circumferentially clamped compressor blades, hereinafter also referred to as the blades. In the method, two or more blades in the assembly are identified as located blades. Each located blade in the assembly has an angular position with respect to an axis of rotation of the assembly. The located blades are maintained in their respective angular positions within the assembly such that the located blades are not circumferentially displaced from their respective angular positions when the assembly is rotated for low-speed balancing.

This low-speed balancing technique comprises an operational step of balancing the compressor stage blades assembly. This step can be conventional in itself such that balancing may be achieved by any one or more of removing material from the rotor/blades assembly, adding material to the rotor/blades assembly, changing position of blades within the assembly, replacing blades in the rotor/blades assembly, adjusting the position of a mass disposed to the rotor/blade assembly and other techniques known to the skilled person.

This low-speed balancing technique comprises an operational step of removing the one or more inserts after the low-speed balancing step has been completed. The present inserts are not used during normal engine operation.

As a result of the located blades, the assembly is divided into a plurality of sectors, of which the number equals number of the located blades. Each sector includes one or more movable blades, of which the number is as equal as possible with other sectors, and is generally limited between a suction side of one located blade and pressure side of another located blade. Moreover, as a result of the located blades maintained in their respective angular positions, the circumferential clearance is subdivided into sectoral circumferential clearances, i.e. smaller clearances or parts formed out of the circumferential clearance, located in each of the sector.

In the method, the movable blades, for each sector, are circumferentially adjusted such that the sectoral circumferential clearance corresponding to the sector is moved circumferentially downstream relative to the movable blades, by moving the movable blades relatively upstream, with respect to a direction of rotation of the compressor stage blades assembly when the compressor stage blades assembly is rotated. One or more inserts are introduced in each of the sectoral circumferential clearances to maintain the relative positions of the sectoral circumferential clearance and the movable blades within each sector. Finally, in the method, a measure of unbalance is determined for the rotor with the at least one compressor stage blades assembly in low-speed balancing conditions. The inserts are removed after low speed balancing and the clearances are kept to accommodate the blade root thermal expansion. The inserts may be referred to as temporary inserts with respect to low-speed balancing. Thus during low-speed balancing, the movable blades are not at different circumferential positions within the assembly with respect to the axis of rotation but are in positions where the movable blades would be during the actual operation of the gas turbine rotor due to blade movement caused due to operational speeds. As a result the beneficial effects of operational-speed balancing or high-speed balancing are achieved without actually having to operate the assembly at operational speeds or high speeds in the course of the balancing operation performed at low-speeds.

In an embodiment of the method, the angular positions of the located blades in the assembly are such that the assembly is divided into equal sectors when the located blades are maintained in their respective angular positions. Due to division in equal sectors or nearly equal there is axis-symmetry or nearly axis-symmetry in the positioning of the located blades circumferentially around the axis of rotation of the assembly and thus better balancing is achieved.

In another embodiment of the method, in identifying the located blades six located blades are identified. Thus six sectors are created and the when equal or at least substantially equal, there is axis-symmetry in the positioning of the six located blades circumferentially around the axis of rotation of the assembly and thus better balancing is achieved.

In another embodiment of the method, maintaining the located blades in their respective angular positions includes fixing each of the located blades in its respective angular position. Thus the present technique is also applied to assemblies where the blades that are identified as the located blades are not pre-fixed in their respective angular positions. Fixing of the located blades facilitates maintaining of the located blades in their respective angular positions. In a related embodiment of the method, each of the located blades is fixed in its respective angular position by inserting a dowel originating from one of the adjacent rotor discs, or from one of the faces of the peripheral channel, and extending into a slot formed in a base part, for example a root section, of the located blade. In another related embodiment of the method, the dowel extending into the slot formed in the base part of the located blade is extended through the slot into another of the adjacent rotor discs, or into the other face of the peripheral channel. These provide ways to fix the located blades into their respective angular positions within the assembly. In yet another related embodiment of the method, the slot formed in the base part of the located blade is discontinuous from the circumferential clearance of the compressor stage blades assembly. Thus the slot in the base part is formed as a tunnel or passageway and not as a cut-out at the end of the base part. This facilitates fixing the located blade in its angular position by inserting a single dowel. The located blade fixed by this way is immovably maintained at its angular position as opposed to a situation where the located blade may be fixed but still be slightly movable within a limited distance defined by the fixing.

In another embodiment of the method, the insert is a shim. There may be one or more shims per insert for some inserts. The shims are easy to introduce as the inserts into the sectoral circumferential clearances and are removable after the balancing is done. In a related embodiment, the shim is made of plastic. The plastic shims are cheap, light in weight, may be rigid or flexible as per the requirement, easy to use, and readily available.

In another embodiment of the method, the inserts are introduced at suction sides of the located blades. Since the assembly is usually rotated in a rotational direction from the suction side to the pressure side for any given blade in the assembly, this provides a easy way to determine where the inserts, and thus the relative positions of the sectoral circumferential clearances and the movable blades, should be prior to the step of determining the measure of unbalance for the assembly. The inserts are removed after low speed balancing. Thus in normal engine operation, i.e. after low-speed balancing, the insets are not present. Removal of the inserts means that the circumferential clearances are maintained during normal operation and accommodate the blade root and/or disc slot thermal expansion and/or movements caused by rotational operation such as centrifugal forces and aerodynamic forces.

The insert may be in the form of a plastic shim and is temporary, such that the insert is removed after low speed balancing. During low speed balancing the inserts cooperate with the located blades and force the blade sectors to the position they occupy during normal (full speed) operation. This stops blade movement during low-speed balancing and enables accurate balancing of the rotor when used at normal engine operation speeds. After low speed balancing the rotor, the inserts are removed because the circumferential clearance between blade roots must be there to accommodate thermal expansion.

The present invention significantly improves the accuracy of low-speed balancing of rotor blade assemblies because the blades' movement is significantly reduced or prevented completely and which otherwise affects the residual unbalance of the rotor assembly. Further, without the present invention, during low-speed balancing it has been found that the unbalance measurements are significantly different from one engine run to another engine run, i.e. because the blades are free to occupy different positions from one engine run to another. Yet further, at normal engine operation conditions, e.g. high-speed, the blades tend to move to a consistent and repeatable position. Therefore the unbalance is relatively consistent between one engine run to another engine run.

BRIEF DESCRIPTION OF THE DRAWINGS

The above mentioned attributes and other features and advantages of the present technique and the manner of attaining them will become more apparent and the present technique itself will be better understood by reference to the following description of embodiments of the present technique taken in conjunction with the accompanying drawings, wherein.

DETAILED DESCRIPTION OF INVENTION

Figure 1:
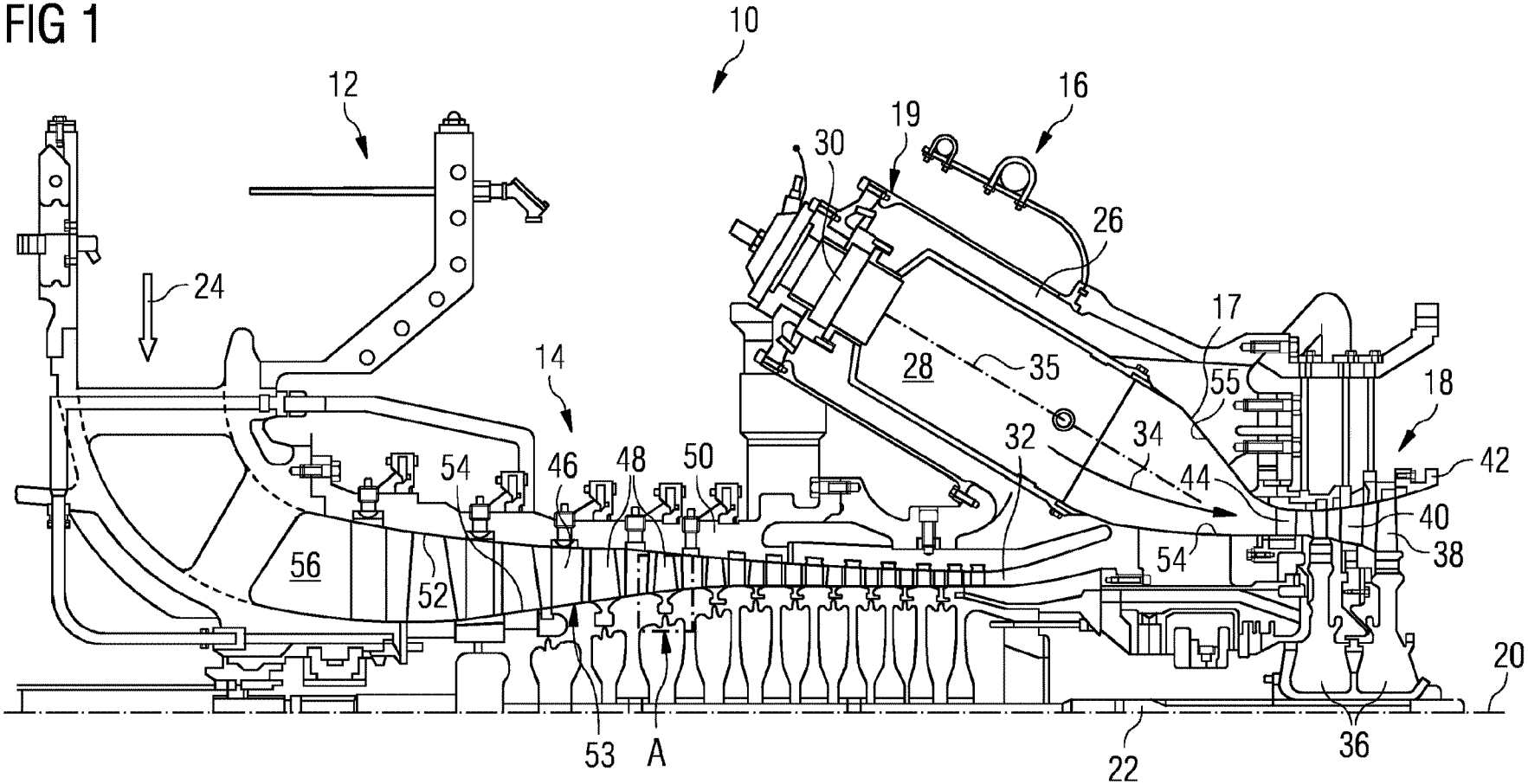
FIG. 1 shows part of a gas turbine engine in a sectional view and in which an exemplary embodiment of a rotor having a compressor stage blades assembly that is balanced by the present technique is incorporated.

Hereinafter, above-mentioned and other features of the present technique are described in details. Various embodiments are described with reference to the drawing, wherein like reference numerals are used to refer to like elements throughout. In the following description, for purpose of explanation, numerous specific details are set forth in order to provide a thorough understanding of one or more embodiments. It may be noted that the illustrated embodiments are intended to explain, and not to limit the invention. It may be evident that such embodiments may be practiced without these specific details.

FIG. 1 shows an example of a gas turbine engine 10 in a sectional view. The gas turbine engine 10 comprises, in flow series, an inlet 12, a compressor or compressor section 14, a combustor section 16 and a turbine section 18 which are generally arranged in flow series and generally about and in the direction of a rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 extending along a longitudinal axis 35 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the combustion gas 34 or working gas from the combustion is channelled through the combustion chamber 28 to the turbine section 18 via a transition duct 17.

This exemplary gas turbine engine 10 has a cannular combustor section arrangement 16, which is constituted by an annular array of combustor cans 19 each having the burner 30 and the combustion chamber 28, the transition duct 17 has a generally circular inlet that interfaces with the combustor chamber 28 and an outlet in the form of an annular segment. An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas 34 from the combustion chamber 28 enters the turbine section 18 and drives the turbine blades 38 which in turn rotate the rotor. The guiding vanes 40, 44 serve to optimise the angle of the combustion or working gas 34 on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades within a peripheral channel formed in a rim of the disk, or may comprise compressor blades circumferentially arranged between two opposing faces 62,64 (shown in FIG. 2) of adjacent rotor discs 60,63 (shown in FIG. 2). Generally the annular array of blades is also referred to as a row 5 (shown in FIG. 3) of blades or compressor blades 8 (shown in FIG. 3) The compressor section 14, also referred to as the compressor 14, also comprises a casing 50 that surrounds the rotor stages and supports the vane stages 46. The guide vane stages include an annular array of radially extending vanes that are mounted to the casing 50. The vanes are provided to present gas flow at an optimal angle for the blades 8 at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of rotor blade stages 48.

The present technique is described with reference to the above exemplary turbine engine having a single shaft or spool connecting a single, multi-stage compressor and a single, one or more stage turbine. However, it should be appreciated that the present technique is equally applicable to two or three shaft engines and which can be used for industrial, aero or marine applications. Furthermore, the cannular combustor section arrangement 16 is also used for exemplary purposes and it should be appreciated that the present technique is equally applicable to annular type and can type combustion chambers.

The terms axial, radial and circumferential are made with reference to the rotational axis 20 of the engine, unless otherwise stated. A part of the compressor 14 demarcated by reference character 'A' in FIG. 1 shows part or section of a compressor stage blades assembly 1 which in turn is shown in FIG. 3. The compressor stage blades assembly 1 constitutes one stage 48 of the rotor of the compressor 14. Details of section A are shown in FIG. 2.

Figure 2:
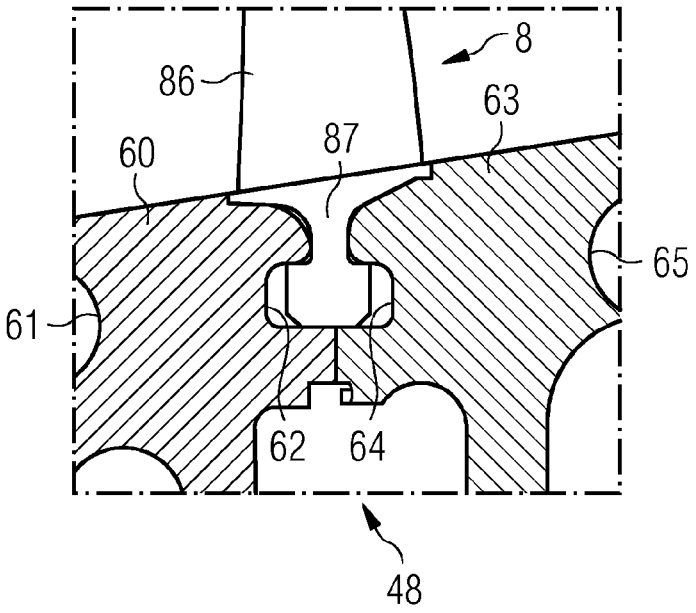
FIG. 2 schematically illustrates a sectional view of a part of the compressor stage blades assembly of FIG. 1.
Figure 3:
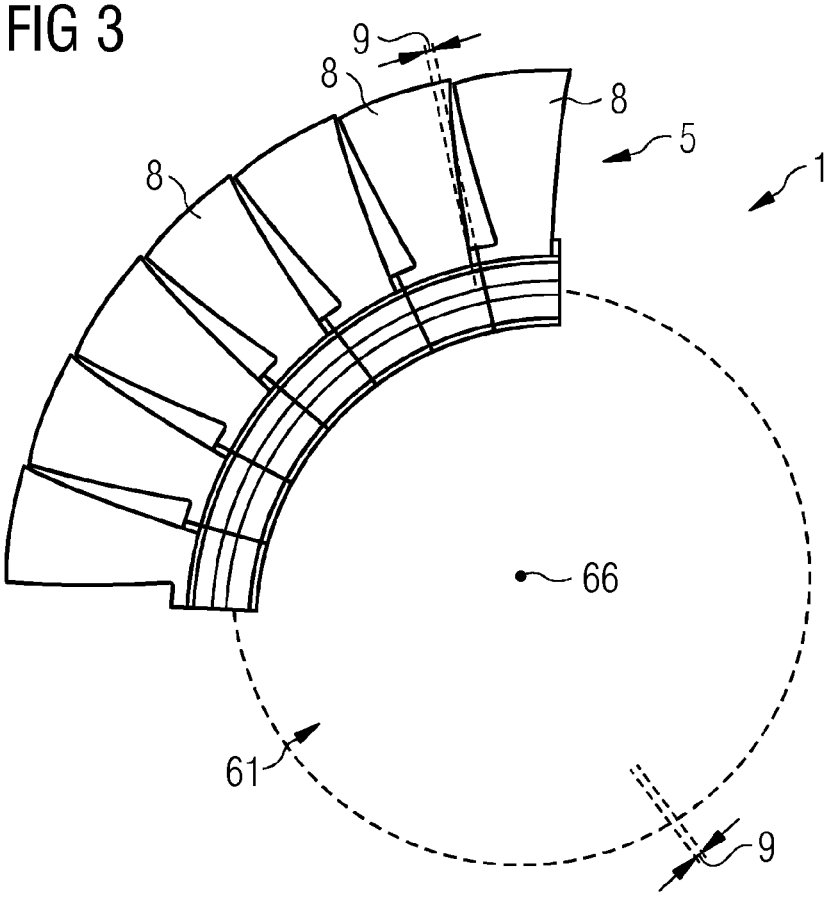
FIG. 3 schematically illustrates an exemplary embodiment of the compressor stage blades assembly forming a stage of a compressor and incorporating a circumferential clearance within the compressor stage blades assembly.

FIG. 2 schematically illustrates a compressor blade 8 arranged or supported between two opposing faces 62,64 of adjacent rotor discs 60,63 to form one stage 48 of the compressor 14. It may be noted that although in the present disclosure, an embodiment of a row of compressor blades circumferentially arranged and supported between two opposing faces of a peripheral channel formed in a rim of one disk to form a stage of a gas turbine compressor rotor is not shown, it may be appreciated by one skilled in the art that such an embodiment is well within the scope of the present technique. The other faces 61, 65 of the adjacent disks 60, 63, respectively, may separately or in combination of opposing faces of their respective other adjacent disks (not shown) may support other rows (not shown) of the compressor blades to form a previous and a later stage of the compressor 14. The compressor blade 8, or the blade 8, has an aerofoil part 86 and a base part 87, generally including a root and a platform. The base parts 87 of a number of the blades 8 are fitted between or arranged between the opposing faces 62,64 with the aerofoil part 86 extending radially outwards.

FIG. 3 schematically depicts a number, particularly seven blades 8 circumferentially arranged between the adjacent disks 60, 63, although in view of FIG. 3 only the face 61 of the disk 60 would be visible as depicted, to form the compressor stage blades assembly 1 having the row 5 of the blades 8. When the assembly 1 is inside the gas turbine engine 10 and when the compressor is operational the assembly rotates around the rotational axis 20, as mentioned hereinabove, however, when the assembly 1 is rotated, along with the rotor within which the assembly 1 is included, for purpose of balancing outside the gas turbine engine 10, the assembly 1 is required to rotate or made to rotate around a center of the assembly 1 and thus an axis 66 of rotation passed through the center of the assembly 1. In between the blades 1, or more particularly in between the base parts 87 (as shown in FIG. 2) of the blades 1, is a clearance allowed or placed to permit the blades 1 to adopt in cases of expansion of one or more of the base parts 87 for example in cases of any thermal expansion of the base parts 87. The clearance, i.e. a gap or space between the blades 8 in the row 5, allows at least some of the blades 8 to move or shift circumferentially. At a given instance the clearance may be collected or accumulated in between any two adjacent blades 8 or may be circumferentially scattered all over the row 5, and is referred to as circumferential clearance 9. FIG. 2 shows the circumferential clearance 9 scattered in two circumferential positions.

In an embodiment of the assembly 1 some of the blades 8 may be fixed in position, or strictly limited in their circumferential movement, relative to the disks 60,63 and in such cases the assembly 1 is divided into two or more, in some cases six or eight, sections and then the circumferential clearance 9 is scattered or distributed or interspersed within the sections.

Figure 4:
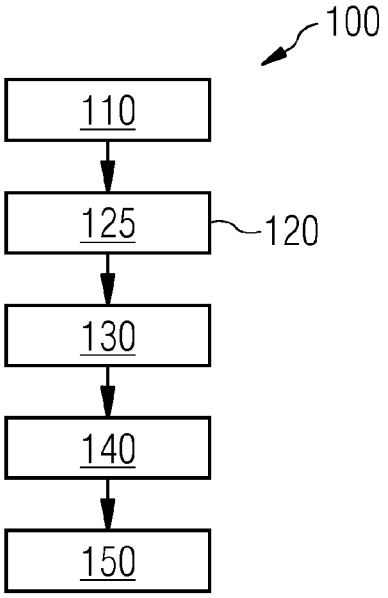
FIG. 4 illustrates a flow chart of an exemplary embodiment of a method of the present technique used for low-speed balancing of the rotor having at least one compressor stage blades assembly of FIG. 3.

FIG. 4 shows a flowchart representing an exemplary embodiment of a method 100 for low-speed balancing of a rotor having at least one assembly 1, and has been explained hereinafter with reference to FIGS. 5 to 11 that schematically depict different steps or scheme of arrangements of the method 100. In the method 100, in a step 110, a plurality of compressor blades 8, or the blades 8, in the assembly 1 are identified as located blades 82. If the assembly 1 has some of the blades 8 that are fixed in position, or are strictly limited in their circumferential movement, relative to the disks 60,63 then these blades 8 are identified as the located blades 82. Alternatively, if there are no fixed blades 8, or blades 8 that are strictly limited in their circumferential movement, relative to the disks 60,63, then at least two or more blades 8 are selected to be identified as located blades 82.

Figure 5:
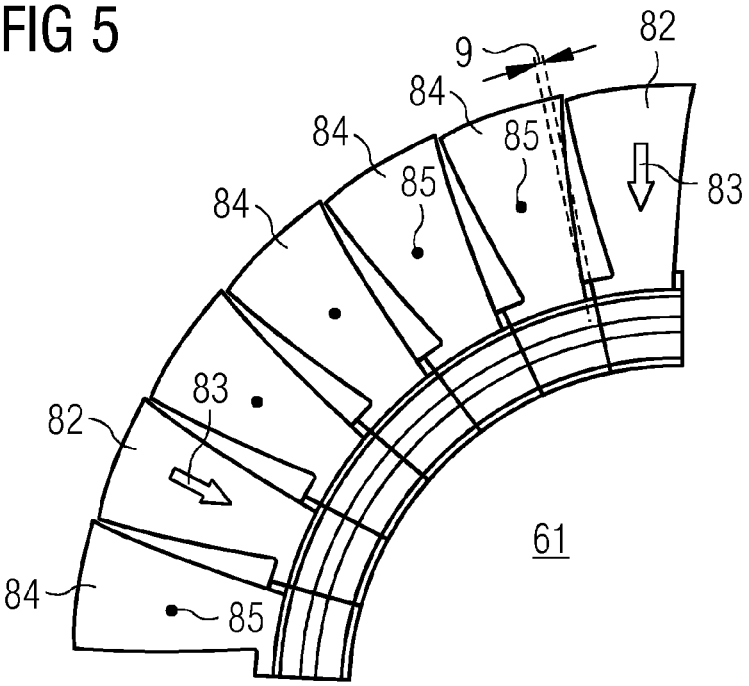
FIG. 5 schematically illustrates a section the compressor stage blades assembly depicting located blades and movable blades along with their respective angular positions within the compressor stage blades assembly and also depicting the circumferential clearance within the compressor stage blades assembly.

The blades 8 to be identified as the located blades 82 are selected axis-symmetrically or nearly axis-symmetrically (in case blade number cannot be divided by sector number) i.e. in such a way that they form an axis-symmetry within the assembly 1, for example as shown in FIG. 5 a first blade 8 is selected, its position is represented in FIG. 5 by an arrow marked with reference numeral 83, i.e. the angular position 83 of that blade 8 with respect to the axis 66, and then after five blades 8, a second blade 8 is selected, its position is also represented in FIG. 5 by an arrow marked with reference numeral 83. These two blades 8 represented in FIG. 5 by the arrows marked with reference numeral 83 are identified as the located blades 82. If these two blades 8 were already fixed then they would have also been identified as the located blades 82. At least some or a part or a portion of the circumferential clearance 9 is present in between the located blades 82 along with the other blades 82 which are free to move circumferentially in-between the two located blades 82 due to the part or the portion of the circumferential clearance 9 that is present in between the two located blades 82. The blades 8 in-between the two located blades of example of FIG. 5 are referred to as movable blades 84 and their respective positions, which are variable, are represented in FIG. 5 by dots marked by reference numeral 85.

In the method 100, in a following step 120, the located blades 82 are maintained at their respective angular positions 83. In embodiments of the assembly 1 where those blades 8 are identified as located blades 82 that are already fixed in position relative to the disks 60,63, due to their property of being fixed the located blades 82 are maintained in their angular positions 83. Alternatively, in embodiments of the assembly 1 where those blades 8 that are identified as located blades 82 are not already fixed in position relative to the disks 60,63, the located blades 82 are maintained 120 in their respective angular positions 83 by fixing the located blades 82 in a step 125 of the method 100.

Figure 7:
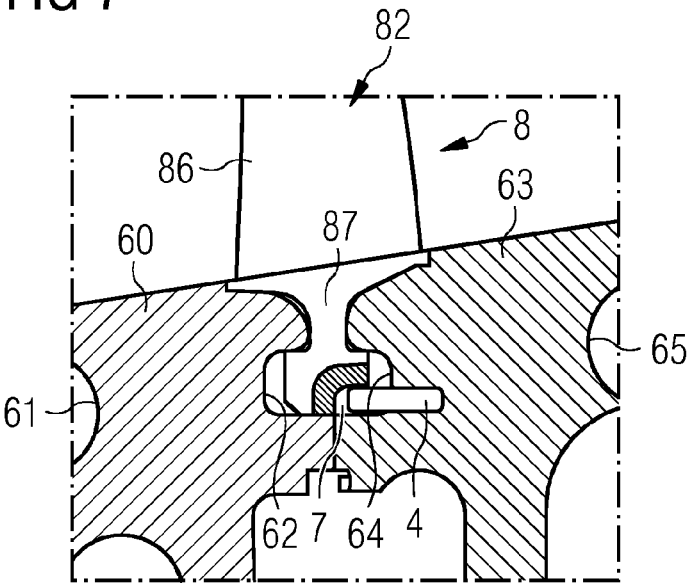
FIG. 7 schematically illustrates a sectional view showing fixing of one of the located blades of FIGS. 5 and 6.
Figure 8:
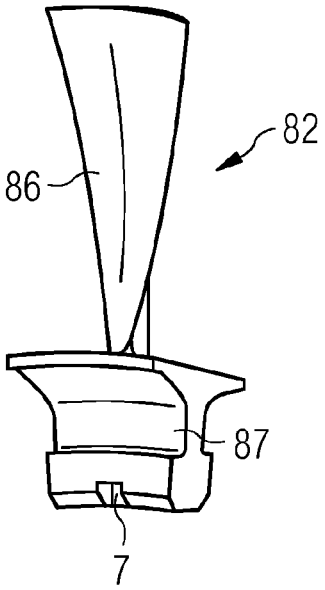
FIG. 8 schematically illustrates a perspective view of the located blade of FIG. 7.
Figure 9:
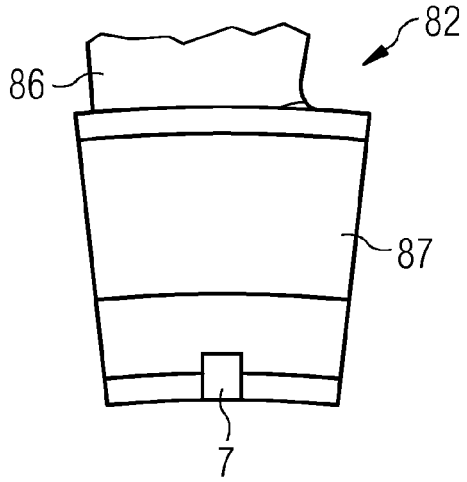
FIG. 9 schematically illustrates a sectional view of the located blade of FIG. 7 when viewed in a different angle as compared to the view of FIG. 8.

FIGS. 7, 8 and 9 schematically depict a way of fixing 125 the located blades 82 in their angular positions. It may be noted that the fixing 125 may be performed after identifying the located blades 82 or may be performed on some blades 82 of the assembly 1, advantageously during making of the assembly 1, which later on are identified as the located blades 82, this is also referred to herein as fixing of the located blades 82. As shown in FIG. 7, each of the located blades 82 is fixed 125 in its respective angular position 83 by inserting a dowel 4 originating from one, the disk 63 in FIG. 7, of the adjacent rotor discs 60,63 and extending into a slot 7 formed in the base part 87 of the located blade 82. The slot 7 is formed as a channel, having any cross-sectional shape for example circular, segment of a circle, U-shaped, triangular, rectangular, any open shape, and so on and so forth. The dowel 4 is elongated rod like structure and may have any cross-sectional shape, advantageously, a shape complementary to the shape of the slot 7. In another embodiment, there may be multiple slots 7 that may be extended into by corresponding dowels 4. As shown in FIGS. 8 and 9, the slot 7 may be formed in a middle area of the base part 87 such that the slot 7 is discontinuous from the circumferential clearance 9, and then a single dowel 4 is sufficient to fix the located blade 82 in its angular position. In one embodiment, as shown in FIG. 7, the slot 7, and thereby extension of the dowel 4 into the slot 7, may be extending either midway or partially into the base part 87. In another embodiment (not shown), the slot 7 may extend all the way through the base part 87, and then the dowel 4 is extended into the slot 7 from one face 64 and through the slot 7 into the other face 62 of the adjacent rotor discs 63,60, respectively.

Figure 6:
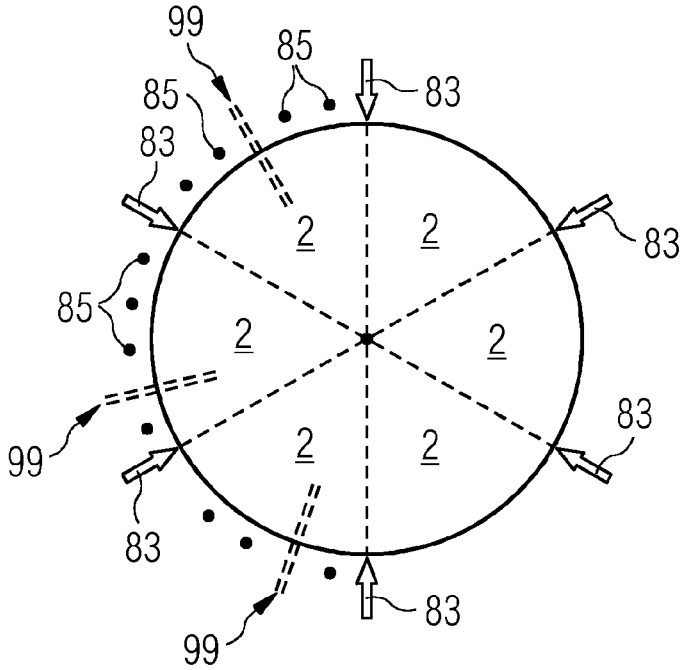
FIG. 6 schematically illustrates a scheme of arrangement of the located blades within the compressor stage blades assembly and resulting sectors and sectoral circumferential clearances.

Referring to FIG. 4 again, as a result of the step 120 of maintaining the located blades 82 in their respective angular positions 83, which may optionally include fixing 125 of the located blades 82 as described hereinabove, the assembly 1 is subdivided into sectors 2 as shown in FIG. 6. FIG. 6 shows angular positions 83 of six axis-symmetrically identified located blades 82, which when maintained 120 in their respective angular positions 83 divide or demarcate in or define within or create in the assembly 1 six sectors 2. A scheme of arrangement of the located blades 82, represented by their respective angular positions 83 within the assembly 1 and resulting sectors 2 are represented in FIG. 6. The located blades 84 are at angular positions 83 at 0 degree, 60 degree, 120 degree, 180 degree, 240 degree and 300 degree (or at vicinity of these angular positions, in case the blade number cannot be divided by 6. For example, if the whole stage consists of 59 blades, five sectors will have 10 blades for each, however one sector can have 9 blades).

Furthermore, the circumferential clearance 9 is also distributed in the sectors 2 as sectoral circumferential clearances 99. In embodiments of the assembly 1, where some of the blades 8 were fixed or pre-fixed in the assembly 1, advantageously during making of the assembly 1, which later on were identified as the located blades 82, the circumferential clearances 9 is already divided into smaller independent gaps or clearances that are referred to as the sectoral circumferential clearances 99.

As is depicted in FIG. 6, the sectoral circumferential clearances 99 are present in a plurality of or each of the sectors 2, although in FIG. 6 only three sectoral circumferential clearances 99 are depicted. Thus as a result of step 120, each sector 2 has sectoral circumferential clearances 99 distributed within its respective sector 2 or accumulated in one or more angular positions with the respective sector 2 and has movable blades 84. There is no specific order in the arrangement of the sectoral circumferential clearances 99 and the movable blades 82 at after the step 120. It may be noted that the number of movable blades 84 in each sector 2 is advantageously the same but may not be exactly same but still substantially similar, for example in FIG. 6 one of the sector 2 has three movable blades 84 while the other two sectors 2 have four movable blades 84. For the other three sectors 2 in FIG. 6 angular positions 85 of movable blades 84 and sectoral circumferential clearances 99 are not depicted in FIG. 6 for sake of simplicity. It may also be noted that the number of the movable blades 84 in different sectors 2 is only depicted for exemplary purposes and not meant as a limitation.

Referring again to FIG. 4, after the step 120, is a step of 130 of circumferentially adjusting the movable blades 84 for each sector 2. The scheme of arrangement of the movable blades 84 and the sectoral circumferential clearances 99 for some of the sectors 2 is depicted schematically in FIG. 10 that can be compared with FIG. 6 for sake of better understanding. In the step 130 the movable blades are adjusted or moved or shifted or slid circumferentially within their respective sector 2 such that the sectoral circumferential clearance 99 is moved circumferentially downstream 68 relative to the movable blades 84 within the sector. The term downstream and upstream as used herein for defining or determining or describing angular positions of the movable blades 84 and of the sectoral circumferential clearances 99 is with respect to a direction 67 of rotation of the assembly 1 when the assembly 1 is rotated or in which the assembly 1 is intended to be rotated during the performance of balancing, which may be same as the direction in which the rotor is intended to rotate when inside the compressor and during operation of the gas turbine 10, of the rotor. Thus for each sector 2, downstream is a position towards the located blade 84 that leads the rotation of the sector 2 and upstream is a position towards the other located blade 84 that follows the rotation of the sector 2, or in other words if the rotation is intended to be in clockwise direction then the located blade 84 of a given sector 2 that comes first when going in anti-clockwise direction is downstream compared to the other located blade 84 of the given sector 2 that comes later. Thus in example of FIG. 10, the arrows represented by reference numeral 68 for their corresponding sectors 2 are downstream in comparison to the arrows represented by reference numeral 69 for their corresponding sectors 2 when the assembly 1 is intended to be rotated in the direction 67. It may be noted that the upstream positions 69 and downstream positions 68 are relative and limited within a given sector 2 and for the direction 67 of rotation.

Figure 10:
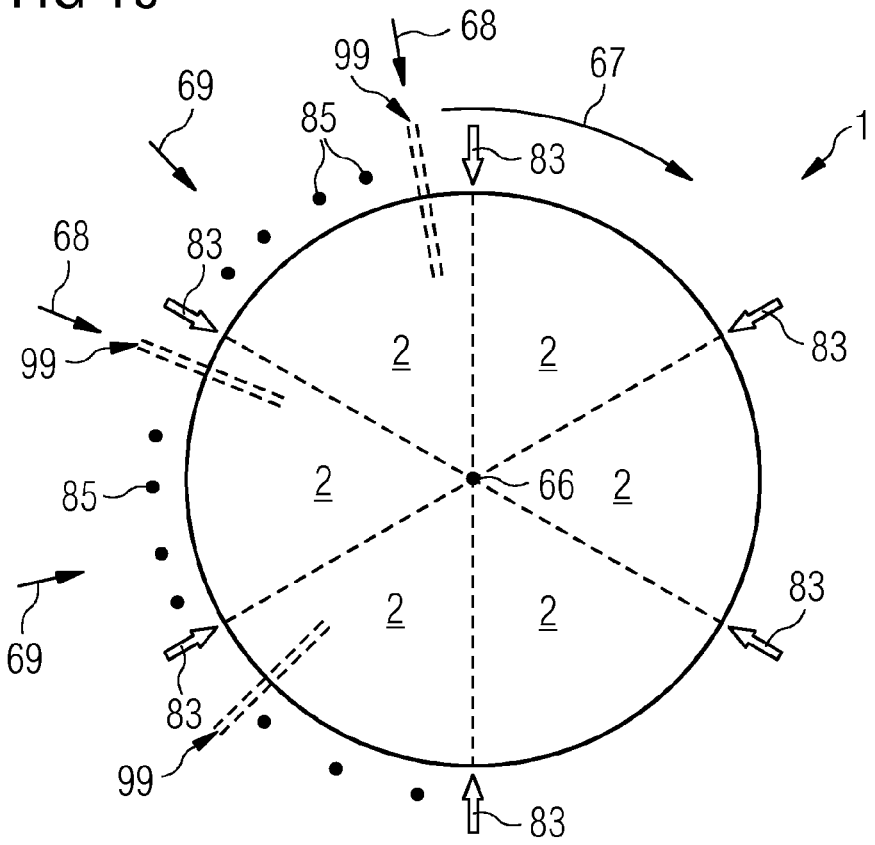
FIG. 10 schematically illustrates a scheme of arrangement, as compared to the scheme of arrangement of FIG. 6, of the movable blades and the sectoral circumferential clearances within sectors of the compressor stage blades assembly after being circumferentially adjusted.

Thus to state simply, as shown in FIG. 10, the sectoral circumferential clearance 99 is a given sector 2 is positioned or moved downstream and relatively the movable blades 84 within the sector 2 are positioned upstream. It may be noted that the sectoral circumferential clearance 99 are not interspersed or distributed within their respective sectors 2 as a result of step 130 of the method 100, but accumulated together as a single gap or space or clearance.

Figure 11:
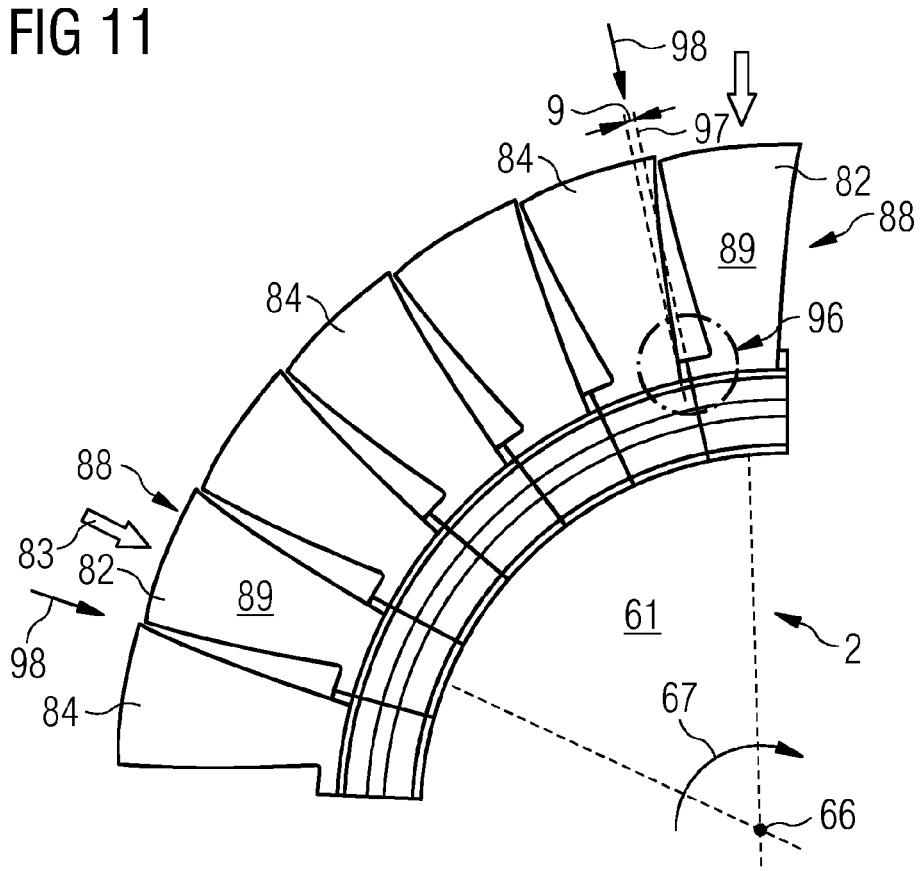
FIG. 11 schematically illustrates one of the sectors of the compressor stage blades assembly with circumferentially adjusted movable blades and with an insert introduced in the sectoral circumferential clearance of the sector; in accordance with aspects of the present technique.

Referring to FIG. 4, in combination with FIG. 11, in the method 100 is a step 140 in which one or more inserts 97 are introduced or inserted in each of the sectoral circumferential clearances 99. As a result of the introduction or insertion of the inserts 97 in each of the sectoral circumferential clearances 99 relative positions of the sectoral circumferential clearance 99 and the movable blades 84 within each sector 2 becomes fixed or locked. In an embodiment of the method 100, the insert 97 is a shim that may be made of plastic. The plastic shims are with different thickness from 0.012 mm to 0.075 mm.

It may be noted that in each sector 2, the movable blades 84 and the sectoral circumferential clearance 99 are limited by a suction side 89 of one located blade 82 and a pressure side of the other located blade 82, as shown in FIG. 11. In the method 100, the direction 67 is such that for a given sector 2 the located blade 84, having the suction side 89 for limiting the movable blades 84 and the sectoral circumferential clearance 99, moves ahead or rotates ahead of the other located blade 82 whose pressure side 88 limits the movable blades 84 and the sectoral circumferential clearance 99 for the given sector 2. Thus in the method 100, the inserts 97 are introduced at suction sides 89 of the located blades 82 that is present or intended to be present downstream of the other located blade 82 for each sector 2.

It may be noted that in one embodiment of the method 100, as shown in FIG. 4, step 130 and step 140 are performed sequentially i.e. step 130 first then step 140, whereas in one embodiment (not shown) of the method 100, step 130 and step 140 are performed simultaneously i.e. the movable blades are adjusted 130 by introducing 140 the insert 97 within the sector 2 and next to the located blade 82 positioned downstream as compared to the other located blade of the sector 2, and as a result of pushing into or inserting into or introducing of the insert 97, the movable blades 84 of the sector 2 are pushed to or moved to the upstream of the sectoral circumferential clearance 99 that accumulates downstream.

Subsequently in the method 100, referring to FIG. 4, is a step 150 of determining a measure of unbalance for the rotor with the at least one assembly 1. In the step 150, the rotor including the assembly 1, along with the inserts 97 in as introduced in step 140, is subjected to low-speed balancing by using balancing equipment and by rotating the assembly 1 as being monitored by the balancing equipment. The rotation is performed in the direction 67. The balancing equipment, equipment for rotating the rotor having the assembly 1, and principles and techniques of balancing at low-speed are well known in the art of rotor balancing and thus not described herein in details for sake of brevity.

It may be noted that the method 100 of the present technique has been described hereinabove for a rotor having one compressor stage blade assembly 1, however it may be appreciated by one skilled in the art that the present method 100 is applicable for a rotor having a plurality of compressor stage blade assemblies 1, for example ten compressor stage blade assemblies 1. In such case, the step 110, the step 120, and optionally the step 125, the step 130 and the step 140 of the method 100 will be performed for all the compressor stage blade assemblies 1 included in the rotor being subjected to low-speed balancing.

While the present technique has been described in detail with reference to certain embodiments, it should be appreciated that the present technique is not limited to those precise embodiments. It may be noted that, the use of the terms 'first', 'second', etc. does not denote any order of importance, but rather the terms 'first', 'second', etc. are used to distinguish one element from another. Rather, in view of the present disclosure which describes exemplary modes for practicing the invention, many modifications and variations would present themselves, to those skilled in the art without departing from the scope and spirit of this invention. The scope of the invention is, therefore, indicated by the following claims rather than by the foregoing description. All changes, modifications, and variations coming within the meaning and range of equivalency of the claims are to be considered within their scope.

The invention claimed is:

1. A method for low-speed balancing of a rotor having at least one compressor stage blades assembly, the compressor stage blades assembly having a row of compressor blades circumferentially clamped and supported by one or more rotor discs to form a stage of a compressor section for a gas turbine engine, and wherein the compressor stage blades assembly includes a circumferential clearance, the method comprising:

selecting a plurality of compressor blades in the compressor stage blades assembly as located blades, wherein each located blade has an angular position with respect to an axis of rotation of the compressor stage blades assembly;

fixing the located blades in their respective angular positions within the compressor stage blades assembly such that the located blades divide the compressor stage blades assembly into a plurality of sectors, wherein each sector comprises one or more movable blades and wherein the circumferential clearance is subdivided into sectoral circumferential clearances;

circumferentially adjusting the movable blades, for each sector, such that the sectoral circumferential clearance within the sector is moved circumferentially downstream relative to the movable blades and with respect to a direction of rotation of the compressor stage blades assembly when the compressor stage blades assembly is rotated;

introducing one or more inserts in each of the sectoral circumferential clearances to maintain relative positions of the sectoral circumferential clearance and the movable blades within each sector; and determining a measure of unbalance for the rotor with the compressor stage blades assembly in low-speed balancing conditions;

balancing the compressor stage blades assembly; and removing the one or more inserts after low-speed balancing has been completed.

2. The method according to claim 1, wherein the angular positions of the located blades in the compressor stage blades assembly are such that the compressor stage blades assembly is divided into equal sectors when the located blades are fixed in their respective angular positions.

3. The method according to claim 1, wherein in selecting the located blades, six located blades are selected.

4. The method according to claim 1, wherein fixing the located blades in their respective angular positions comprises fixing each of the located blades in its respective angular position with a dowel.

5. The method according to claim 4, wherein each of the located blades is fixed in its respective angular position by inserting the dowel originating from at least one of the rotor discs supporting the row of the compressor blades and extending into a slot formed in a base part of the located blade.

6. The method according to claim 5, wherein the dowel extending into the slot formed in the base part of the located blade is extended through the slot into another of the one or more rotor discs.

7. The method according to claim 5, wherein the slot formed in the base part of the located blade is discontinuous from the circumferential clearance of the compressor stage blades assembly.

8. The method according to claim 1, wherein the insert is a shim.

9. The method according to claim 8, wherein the shim is made of plastic.

10. The method according to claim 1, wherein the inserts are introduced at suction sides of the located blades.

* * * * *